US011580827B2

(12) United States Patent
Tart

(10) Patent No.: US 11,580,827 B2
(45) Date of Patent: Feb. 14, 2023

(54) SIGNAL DISPLAYS

(71) Applicant: Baker Hughes Oilfield Operations LLC, Houston, TX (US)

(72) Inventor: Michael Alan Tart, Gardnerville, NV (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/465,974

(22) Filed: Sep. 3, 2021

(65) Prior Publication Data

US 2022/0114869 A1 Apr. 14, 2022

Related U.S. Application Data

(60) Provisional application No. 63/089,054, filed on Oct. 8, 2020.

(51) Int. Cl.
*G08B 5/36* (2006.01)

(52) U.S. Cl.
CPC ..... *G08B 5/36* (2013.01)

(58) Field of Classification Search
CPC ..... G08B 5/36; F04B 49/065; E21B 41/00
See application file for complete search history.

(56) References Cited

U.S. PATENT DOCUMENTS

| | | | | |
|---|---|---|---|---|
| 7,182,283 | B1 * | 2/2007 | Santucci | B02C 15/06 241/117 |
| 7,827,008 | B2 * | 11/2010 | Tart | G05B 23/0264 702/185 |
| 8,852,115 | B2 * | 10/2014 | Muir | A61B 5/14551 600/323 |
| 9,182,300 | B2 * | 11/2015 | Themm | G01L 1/00 |
| 9,874,472 | B2 * | 1/2018 | Tarassenko | G01H 1/006 |
| 9,984,452 | B2 * | 5/2018 | Ando | G06K 9/00536 |
| 11,269,322 | B2 * | 3/2022 | Unuma | G05B 23/0283 |

* cited by examiner

*Primary Examiner* — John A Tweel, Jr.
(74) *Attorney, Agent, or Firm* — Mintz Levin Cohn Ferris Glovsky and Popeo, PC

(57) ABSTRACT

A method for determining and providing signal displays is provided. The method can include receiving data characterizing signal values. The data can be received from a sensor monitoring an asset, such as a rotating machinery asset. The method can also include receiving data characterizing a threshold trigger level associated with the asset. The method can further include determining a signal display for the asset. The method can also include providing the signal display in a graphical user interface. Monitoring systems for monitoring industrial assets and providing signal displays corresponding to an operation of the industrial assets are also provided.

17 Claims, 4 Drawing Sheets

SIGNAL DISPLAYS

RELATED APPLICATION

This application claims priority under 35 U.S.C. § 119(e) to U.S. Provisional Application No. 63/089,054, filed Oct. 8, 2020, the entire contents of which are hereby expressly incorporated by reference herein.

BACKGROUND

Industrial operations can include monitoring assets to characterize and detect changes in an operation of the assets. Assets can include rotating machinery, which can be associated with oil and gas production environments. During asset monitoring and inspection, it can be desirable to provide visual displays of signal data to determine asset operation and perform maintenance planning for assets.

SUMMARY

In one aspect, a method is provided. In an embodiment, the method can include receiving data characterizing signal values. The data can be received from a sensor monitoring an asset. The method can also include receiving data characterizing a threshold trigger level associated with the asset. The method can further include determining a signal display for the asset. The method can also include providing the signal display.

In another embodiment, the sensor can be a speed sensor, a phase reference sensor, a vibration sensor, an eddy current proximity sensor, a magnetic pick up sensor, an optical sensor, or a capacitive sensor.

In another embodiment, the method can further include receiving data characterizing a hysteresis value associated with the asset.

In another embodiment, the signal display can be provide in a graphical user interface included in a display coupled to a monitoring system. In another embodiment, the signal display can include at least one of a waveform display, a bar graph display, and a time-based display. In another embodiment, the bar graph display is provided with the waveform display. In another embodiment, the bar graph display can include an indication of a maximum signal value and an indication of a minimum signal value.

In another embodiment, the bar graph display can include an indication of the threshold trigger level. In another embodiment, the bar graph display can include an indication of an upper hysteresis value and a lower hysteresis value. In another embodiment, the bar graph display can include a distance indicator corresponding to a distance between the sensor and the asset. In another embodiment, the bar graph display can include a signal value legend indicating units and a range of the signal values.

In another embodiment, the time-based display can include an indication of the threshold trigger level. In another embodiment, the time-based display can include an indication of an upper hysteresis value and an indication of a lower hysteresis value.

In another aspect, a system is provided. In an embodiment, the system can include a rotating machinery asset. The system can also include a sensor coupled to the rotating machinery asset. The system can further include a computing device coupled to the sensor. The computing device can include a display, a memory storing computer readable, executable instructions, and at least one data processor configured to receive signal values from the sensor. The at least one data processor can be configured to execute the instructions to perform operations including receiving data characterizing signal values. The operations can also include receiving data characterizing a threshold trigger level associated with the rotating machinery asset. The operations can also include determining a signal display for the rotating machinery asset. The operations can also include providing the signal display in the display.

In another embodiment, the rotating machinery asset can be a compressor shaft. In another embodiment, the signal display can be determined based on the threshold trigger level. In another embodiment, the threshold trigger level can be stored in the memory of the computing device. In another embodiment the threshold trigger level can be provided as an input to the computing device by a user. In another embodiment, the threshold trigger level can be automatically determined based on the received signal values.

Non-transitory computer program products (i.e., physically embodied computer program products) are also described herein that store instructions, which when executed by one or more data processors of one or more computing systems, causes at least one data processor to perform operations herein. Similarly, computer systems are also described herein that may include one or more data processors and memory coupled to the one or more data processors. The memory may temporarily or permanently store instructions that cause at least one processor to perform one or more of the operations described herein. In addition, methods can be implemented by one or more data processors either within a single computing system or distributed among two or more computing systems. Such computing systems can be connected and can exchange data and/or commands or other instructions or the like via one or more connections, including a connection over a network (e.g. the Internet, a wireless wide area network, a local area network, a wide area network, a wired network, or the like), via a direct connection between one or more of the multiple computing systems, etc.

DESCRIPTION OF DRAWINGS

These and other features will be more readily understood from the following detailed description taken in conjunction with the accompanying drawings, in which.

Figure 1:
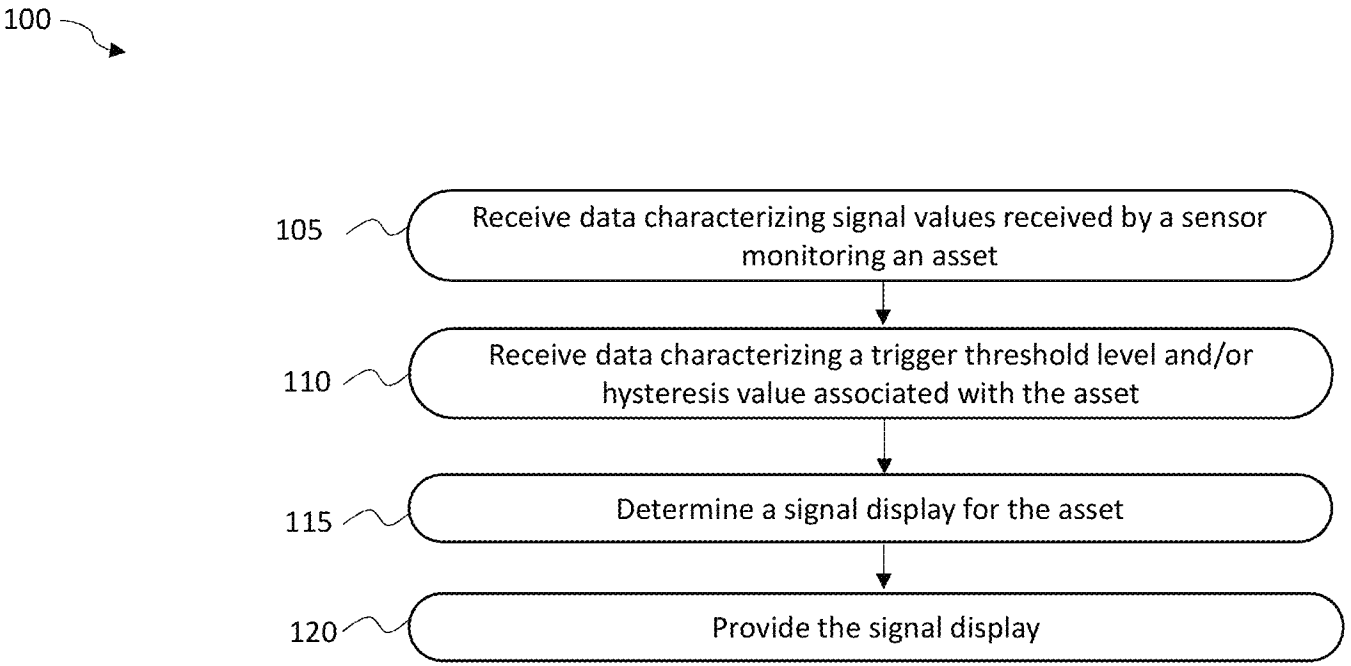
FIG. 1 is a flow diagram illustrating one embodiment of a method for determining and providing a signal display associated with an industrial asset using the monitoring system described herein.

It is noted that the drawings are not necessarily to scale. The drawings are intended to depict only typical aspects of the subject matter disclosed herein, and therefore should not be considered as limiting the scope of the disclosure.

DETAILED DESCRIPTION

Embodiments of the present disclosure describe systems and methods for determining and providing signal displays associated with rotating machinery for use in asset inspection and monitoring of assets in an oil and gas production environment. However, it can be understood that embodiments of the disclosure can be employed for providing signal displays for inspection and monitoring of rotating machinery assets in any environment or in non-industrial environments without limit.

A common technique for monitoring and inspecting rotating machinery is to observe a mark or a notch on a rotating shaft of the machinery using a sensor. The sensor may detect passage of the mark or notch on the rotating shaft and may generate a speed signal and/or a phase signal associated with the rotation of the shaft and the operation of the machinery. Monitoring systems typically require input of a triggering set point and an amount of hysteresis to use in association with the triggering set point.

When a triggering set point or threshold value is reached, for example, under edge detection conditions, the monitoring system described herein can determine and provide visual signal data, such as signal plots. The signal plots can be associated with speed or phase reference measurements of an industrial asset, such as a rotating machinery component.

The monitoring system described herein can determine and provide a waveform display of an input signal received at a sensor coupled to a rotating machinery. The waveform display can be overlaid with a threshold value and hysteresis values to detect an edge or change in the signal. In some embodiments, the monitoring system can determine threshold values dynamically based on a variance of the input signal. The waveform display can be updated to show the actual threshold value being applied to the rotating machinery by the monitoring system.

The monitoring system can also determine and provide a bar graph display. The bar graph display can be augmented with the same information added to the waveform display. For example, the bar graph display can include a threshold value and hysteresis values used to detect an edge or change in the signal. The bar graph display can also show a range of signal values over time and can thus provide the minimum and maximum signal values occurring over a period of time. In some embodiments, the bar graph display can provide the current signal value with the minimum and maximum signal values. Showing the current signal value can be beneficial in conditions where the rotating machinery is operating at slow speeds.

Typically, monitoring systems display an average input signal value in bar graph displays and a sensor signal in waveform displays. Such pre-determined display formats make it difficult to configure triggering or threshold parameters within the monitoring system. These display formats also limit the ability of operators to efficiently troubleshoot the monitoring system when threshold values are not reached, for example during routine operation when monitoring the rotating machinery. Signal meters and oscilloscopes can also be employed to assess sensor signal values via trigger circuits, but the sensor signal values must be buffered and threshold and/or hysteresis values must be known. In addition, assumptions must be made about how the triggering is to be performed. Such configurations can require additional specialized equipment and can be error prone to use when threshold values are constantly changing.

The improved visual signal displays described herein enable easier configuration and troubleshooting of monitoring systems including speed sensors and/or phase references. The improved visual displays described herein provide a range of signal values, from minimum to maximum, and a can show the dynamically changing current signal value for any given point in time with respect to the range of signal values. When deployed with rotating machinery operating at slower speeds, the monitoring system can determine and provide an indication of the instantaneous position of the shaft in reference to the sensor signal values.

The monitoring system can receive inputs of a trigger parameter or threshold value and hysteresis levels and can overlay this data on the bar graph display. In some embodiments, the monitoring system can automatically determine the triggering parameter or threshold value based on the received sensor input signal. The triggering parameter or threshold value can be continually updated and provided on the bar graph display. Additionally, the threshold value and hysteresis values can be provided on time-based waveform displays to aid troubleshooting of threshold triggering.

The monitoring system described herein beneficially provides improved visual displays of sensor signal data for use in monitoring rotating machinery. The monitoring system is provided as an integrated system and does not require additional tools or specialized equipment to be deployed to an inspection site where the rotating machinery is located. In this way, the monitoring system can be configured to allow remote monitoring and diagnosis of an asset at an inspection site without requiring inspection personnel to be physically present.

Embodiments of the present disclosure are directed to improved systems and methods for providing improved visual signal displays for rotating machinery. The improved visual signal displays may be determined and provided with regard to inspection and monitoring procedures using a monitoring system as described herein.

FIG. 1 is a flow diagram illustrating one embodiment of a method 100 for determining and providing signal displays for use in monitoring and inspection of a rotating machinery using a monitoring system as described herein. As shown, the method 100 includes operations 105-120. However, it can be understood that, in alternative embodiments, one or more of these operations can be omitted and/or performed in a different order than illustrated.

In operation 105, data characterizing signal values received by a sensor monitoring an asset is received by a monitoring system. The signal values can be associated with speed signals that are sensed using a displacement sensor, such as an eddy current sensor, that detects a feature (e.g., a notch or a projection) on the shaft of the asset. The passage of the feature by the sensor can cause a change in a voltage output of the sensor. The monitoring system can be configured to detect this change in the voltage using a threshold and hysteresis settings.

In operation 110, data characterizing a threshold trigger level and/or hysteresis values associated with the asset can be received by the monitoring system. The threshold trigger level can correspond to a signal value at which signal data, such as displayed signal plots can be provided. Thus, the threshold trigger level can be a trigger set point that can be used to cause signal displays and signal data to be provided in a monitoring system. In some embodiments, hysteresis inputs can be provided or used in association with the triggering set point.

When a triggering set point or threshold value is reached, for example, under edge detection conditions, the monitoring system described herein can determine and provide visual signal data, such as signal plots. In some embodiments, the threshold trigger level, as well as upper and lower hysteresis levels can be manually provided to the monitoring system. In some embodiments, the monitoring system can automatically determine the threshold trigger level based on the signal values received by the sensor. The monitoring system can automatically determine the threshold trigger level by measuring the positive and negative peaks of the signal and identifying the threshold trigger point as the signal value that occurs at the middle of the measured range.

In operation 115, the monitoring system can determine a signal display for the asset. In some embodiments, the monitoring system can determine one or more signal displays. For example, the signal displays can include a waveform display, a bar graph display, and/or a time-based display. In some embodiments, the bar graph display can be determined to be provided with the time-based display. The time-based display can include the waveform display of the signal obtained by the sensor. In some embodiment, the signal display or updates to a signal display can be determined based on data characterizing the signal values received by the monitoring system. For example, in some embodiments, the threshold trigger level can be determined automatically and continually by the monitoring system and updates to the threshold trigger level can be determined so as to provide a real-time display of the threshold trigger level within the bar graph display and/or the time-based display.

In operation 120, the signal display can be provided. In some embodiments, the bar graph display, the waveform display, and/or the time-based display can be provided in a graphical user interface (GUI) provided on a display coupled to the monitoring system. In some embodiments, the display can be coupled to a computing device of a monitoring system. In some embodiments, the monitoring system can provide the signal displays on a display of a remote computing device communicatively coupled to the monitoring system via a network. In some embodiments, the signal displays can be stored in a memory of the monitoring system.

Figure 2:
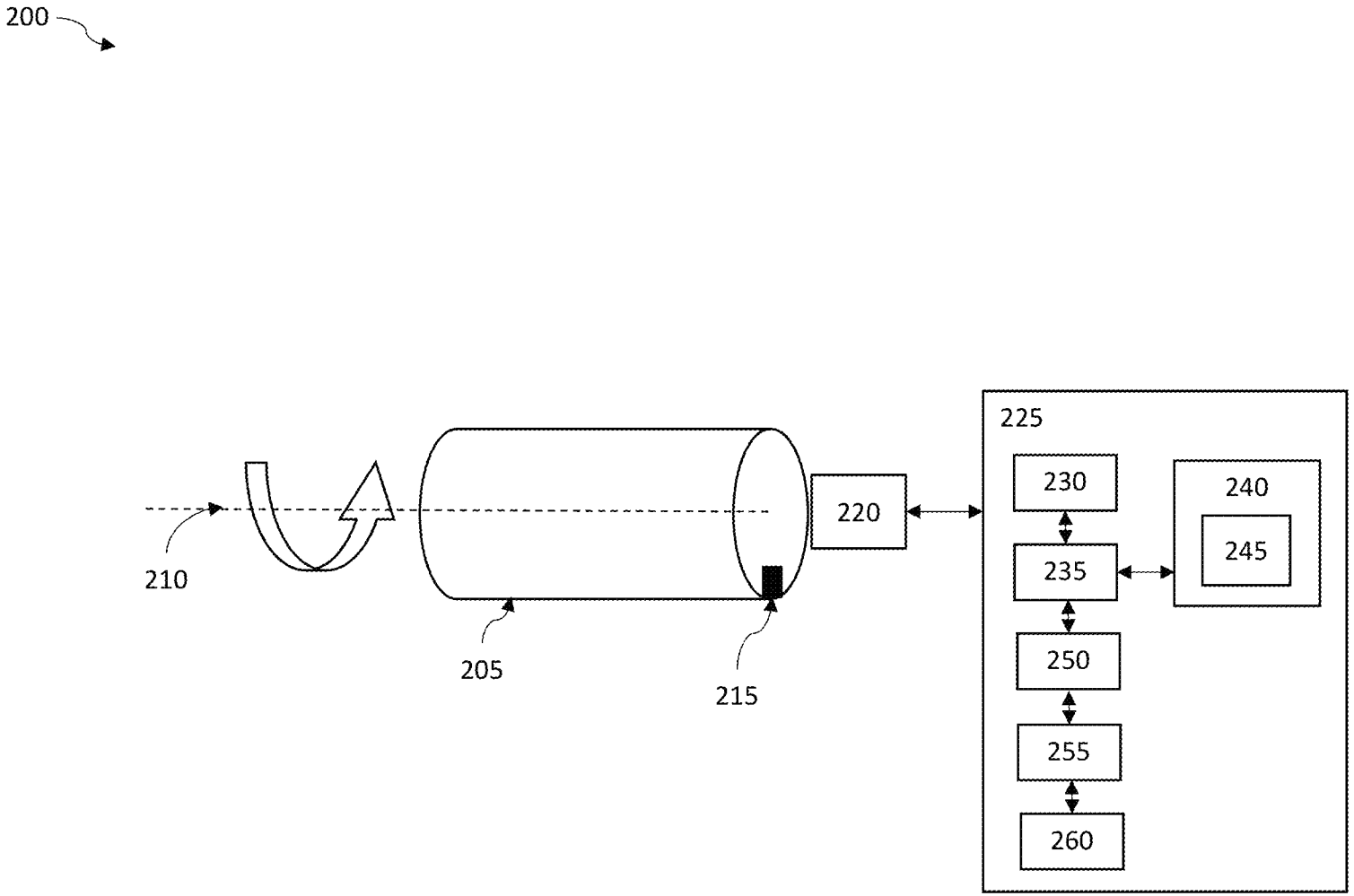
FIG. 2 is a diagram illustrating an exemplary monitoring system configured to determine and provide signal displays according to the methods described herein.

FIG. 2 is a diagram illustrating an exemplary monitoring system 200 configured to determine and provide signal displays according to the methods described herein. As shown in FIG. 2, a rotating machinery 205, such as a shaft of a compressor, can rotate about an axis 210. A notch, mark, or protrusion 215 can be included in or on the rotating machinery 205. As the rotating machinery 205 rotates about the axis 210, the notch or mark 215 will pass the sensor 220 coupled to the rotating machinery 205. A signal value can be generated by the sensor 220 as the notch or mark 215 passes the sensor 220. The signal values can be provided visually in one or more signal displays described herein.

The monitoring system can include the sensor 220, and a computing device 225. The computing device 225 can include a memory 230, a data processor 235, and a display 240. The display 240 can include and provide a GUI 245 in which signal displays corresponding to the operation and rotation of the rotating machinery 205 can be provided to a user.

The sensor 220 can include a speed sensor, a phase reference sensor, or a vibration sensor. In some embodiments, the sensor 220 can include an eddy current proximity sensor, a magnetic pickup sensor, an optical sensor, or a capacitive sensor.

The computing device 225 can include at least one memory 230, a processor 235, I/O bus 250, input device 255, and output device 260. In some embodiments, the computing device 225 can be located at the same location as the sensor 220. In some embodiments, the computing device 225 and/or the display 240 can be located remotely from sensor 220. In this way, remote monitoring can be performed. In some embodiments, the input device 255 and/or the display 240 can include a touch-screen device capable of receiving user inputs via a stylus or a user's finger.

In operation, as the notch or mark 215 passes the sensor 220, signal values are generated by the sensor 220. Data characterizing the signal values are received by the computing device 225 and a signal display can be determined. The computing device 225 can provide one or more signal displays on the display 240. In some embodiments, the signal displays can be provided in a GUI 245. The computing device 225 can determine the signal display to provide based on the received data from the sensor 220 as well as trigger threshold levels and hysteresis values received by the computing device 225. In some embodiments, the computing device 225 can receive the trigger threshold levels and the hysteresis values via manual input from a user, or from a memory 230 of the computing device 225. In some embodiments, the trigger threshold levels and hysteresis values can be automatically determined by the computing device 225 based on the data received from the sensor 220.

Figure 3:
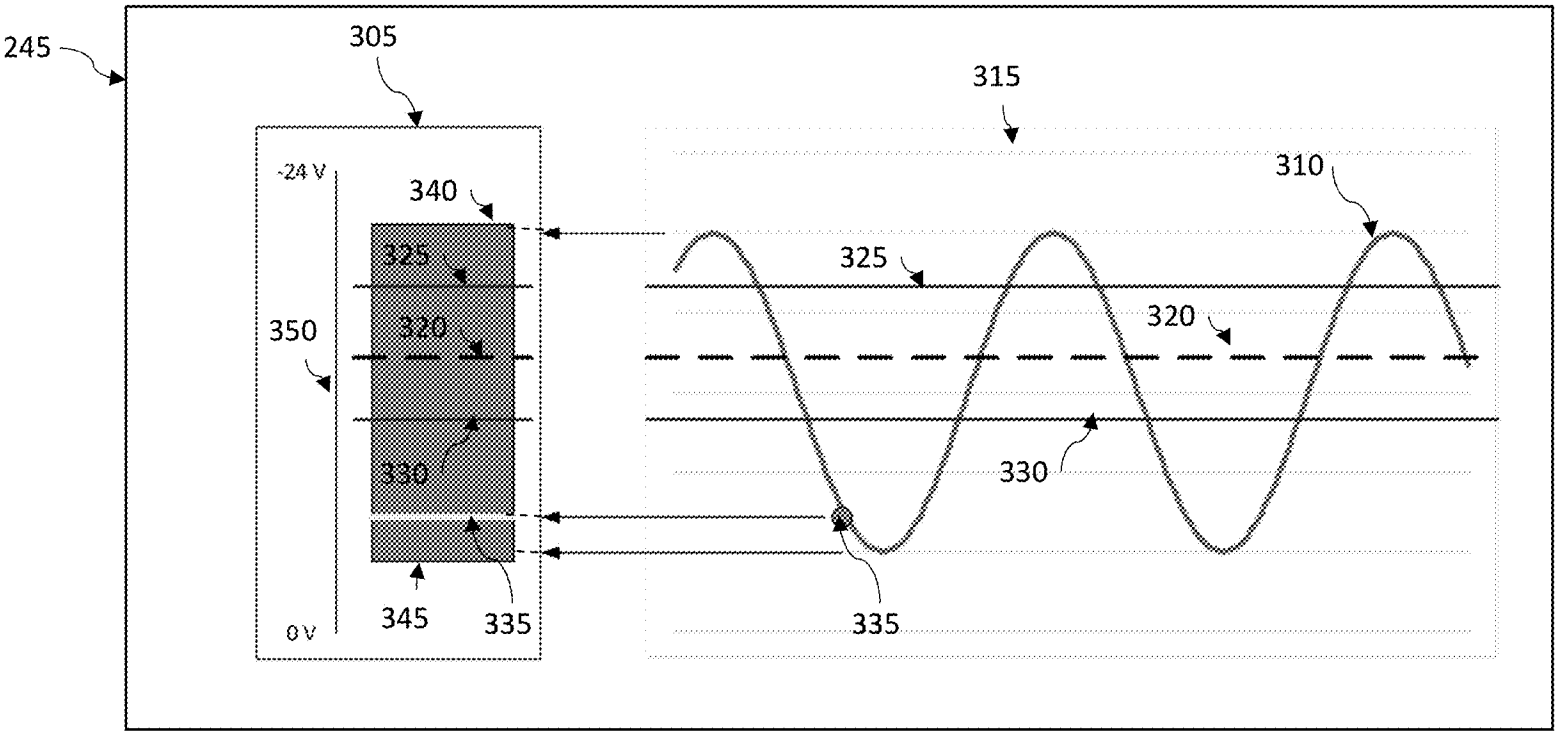
FIG. 3 is a diagram illustrating a signal display according to embodiments described herein.

FIG. 3 is a diagram illustrating a signal display according to embodiments described herein. As shown in FIG. 3, the GUI 245 can provide a bar graph display 305 that can correspond to the signal values included in the signal 310 output from the transducer. The GUI 245 can also provide a time-based representation or display 315 including a waveform display 310 of the signal observed by the sensor 220

As further shown in FIG. 3, the bar graph display 305 can be provided with and can correlate to aspects of the waveform display 310 associated with the signal. For example, the bar graph display 305 can include an indication of the maximum signal value 340 and an indication of the minimum signal value 345 associated with the position of the rotating machinery 205. The bar graph display 305 can also include an indication of the trigger threshold level 320, as well as an indication of an upper hysteresis vale 325 and an indication of a lower hysteresis value 330. The bar graph display 305 can also include a distance indication 335 corresponding to a distance between the sensor 220 and the rotating machinery 205 at the current rotational angle of the rotating machinery. The distance indication 335, the maximum signal value 340, and the minimum signal value 345 can dynamically update in the GUI 245 based on the signal values received by the sensor 220. The bar graph display 305 can also include a signal value legend 350 illustrating the units and range of the received signal values.

Figure 4:
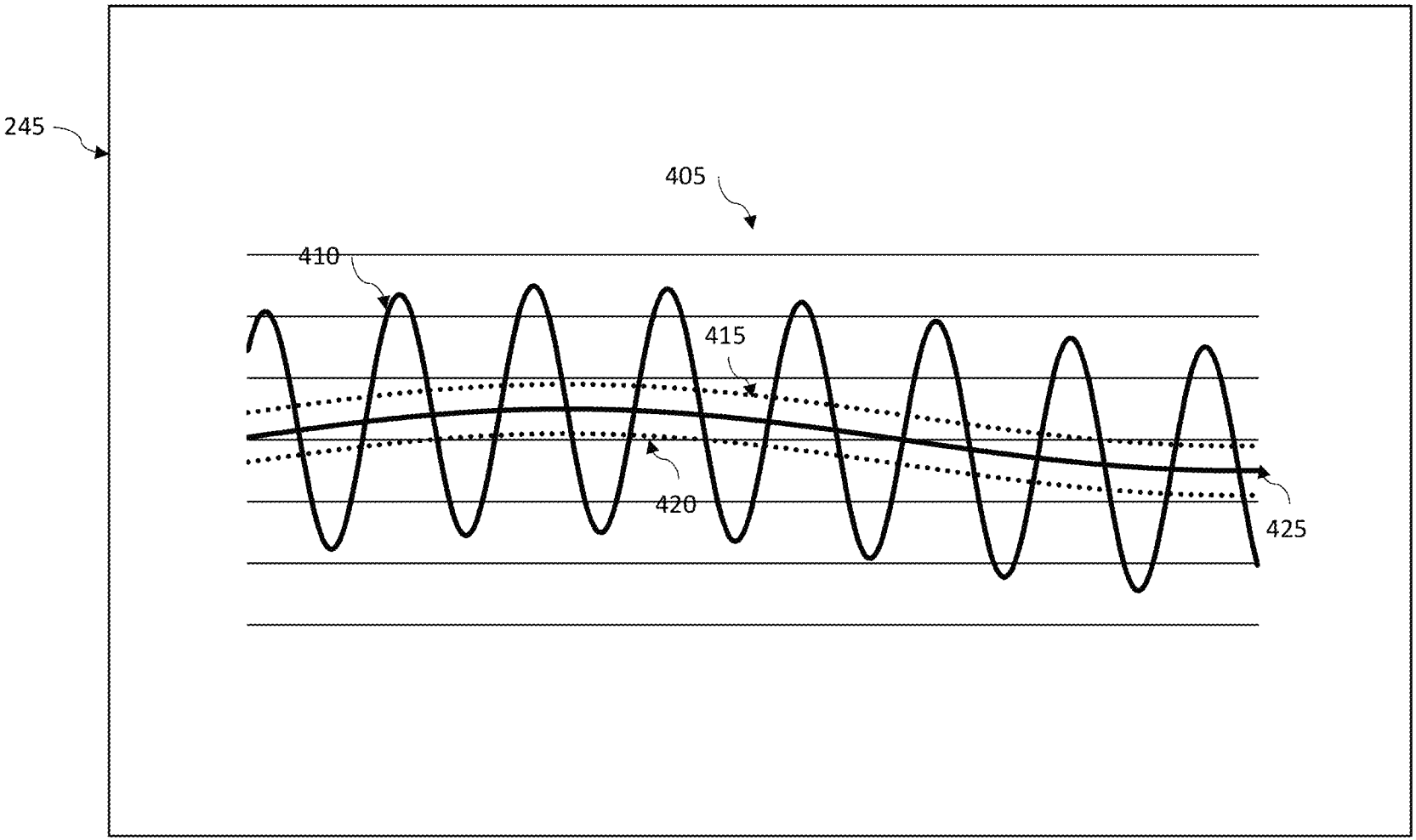
FIG. 4 is a diagram illustrating a time-based display according to embodiments described herein.

FIG. 4 is a diagram illustrating a time-based display according to embodiments described herein. As shown in FIG. 4, the GUI 245 can include a time-based representation or display 405. The time-based display 405 can include the time-based representation of the signal values received from the sensor 220. The signal values can be provided as a waveform display 410. The time-based display 405 can also include an indication of an upper hysteresis value 415, an indication of a lower hysteresis value 420, and an indication of the trigger threshold level 425. The time-based display 405 can be useful in troubleshooting issues with triggering.

In some embodiments, the GUI 245 can provide the bar graph display 305 and the time-based display 405 at the same time within the GUI 245. In some embodiments, the GUI 245 can provide the bar graph display 305, and the time-based display 405 at different times within the GUI 245.

Exemplary technical effects of the methods, and systems described herein include, by way of non-limiting example improved displays of signal values associated with rotating machinery. The improved signal displays provide a more intuitive graphical user interface for monitoring industrial assets. For example, the signal displays described herein provide a more user-friendly display of trigger threshold levels, upper and lower hysteresis values, minimum and maximum position data of the rotating machinery, and the current position value of rotating machinery. The signal displays described herein advantageously provide enhanced monitoring and troubleshooting capabilities to a monitoring system. For example, the monitoring system can automatically determine and can dynamically provide a triggering threshold value or level based on the received signal data. A further benefit of the monitoring system described herein is the ability to remotely monitor rotating machinery via the signal displays provided to a remote computing device coupled to the monitoring system. In this way, on-site monitoring and inspection requiring specialized equipment and dedicated personnel can be replaced by the integrated monitoring system described herein. This can reduce the time needed to perform inspection and/or monitoring of industrial assets and can minimize the risk of human injury when performing on-site inspection or monitoring.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

The subject matter described herein can be implemented in analog electronic circuitry, digital electronic circuitry, and/or in computer software, firmware, or hardware, including the structural means disclosed in this specification and structural equivalents thereof, or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices); magnetic disks, (e.g., internal hard disks or removable disks); magneto-optical disks; and optical disks (e.g., CD and DVD disks). The processor and the memory can be supplemented by, or incorporated in, special purpose logic circuitry.

To provide for interaction with a user, the subject matter described herein can be implemented on a computer having a display device, e.g., a CRT (cathode ray tube) or LCD (liquid crystal display) monitor, for displaying information to the user and a keyboard and a pointing device, (e.g., a mouse or a trackball), by which the user can provide input to the computer. Other kinds of devices can be used to provide for interaction with a user as well. For example, feedback provided to the user can be any form of sensory feedback, (e.g., visual feedback, auditory feedback, or tactile feedback), and input from the user can be received in any form, including acoustic, speech, or tactile input.

The techniques described herein can be implemented using one or more modules. As used herein, the term "module" refers to computing software, firmware, hardware, and/or various combinations thereof. At a minimum, however, modules are not to be interpreted as software that is not implemented on hardware, firmware, or recorded on a non-transitory processor readable recordable storage medium (i.e., modules are not software per se). Indeed "module" is to be interpreted to always include at least some physical, non-transitory hardware such as a part of a processor or computer. Two different modules can share the same physical hardware (e.g., two different modules can use the same processor and network interface). The modules described herein can be combined, integrated, separated, and/or duplicated to support various applications. Also, a function described herein as being performed at a particular module can be performed at one or more other modules and/or by one or more other devices instead of or in addition to the function performed at the particular module. Further, the modules can be implemented across multiple devices and/or other components local or remote to one another. Additionally, the modules can be moved from one device and added to another device, and/or can be included in both devices.

The subject matter described herein can be implemented in a computing system that includes a back-end component (e.g., a data server), a middleware component (e.g., an application server), or a front-end component (e.g., a client computer having a graphical user interface or a web browser through which a user can interact with an implementation of the subject matter described herein), or any combination of such back-end, middleware, and front-end components. The components of the system can be interconnected by any form or medium of digital data communication, e.g., a communication network. Examples of communication networks include a local area network ("LAN") and a wide area network ("WAN"), e.g., the Internet.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. A method comprising:

receiving data characterizing signal values, the data received from a sensor monitoring a rotating machinery asset;

receiving data characterizing a threshold trigger level associated with the rotating machinery asset;

determining a signal display for the rotating machinery asset; and providing the signal display, wherein the signal display includes a bar graph display provided with a waveform display, and the bar graph display includes an indication of the trigger threshold level.

2. The method of claim 1, wherein the sensor is a speed sensor, a phase reference sensor, a vibration sensor, an eddy current proximity sensor, a magnetic pick up sensor, an optical sensor, or a capacitive sensor.

3. The method of claim 1, further comprising receiving data characterizing a hysteresis value associated with the asset.

4. The method of claim 1, wherein the signal display is provided in a graphical user interface included in a display coupled to a monitoring system.

5. The method of claim 1, wherein the signal display further comprises a time-based display.

6. The method of claim 1, wherein the bar graph display includes an indication of a maximum signal value and an indication of a minimum signal value.

7. The method of claim 1, wherein the bar graph display includes an indication of an upper hysteresis value and an indication of a lower hysteresis value.

8. The method of claim 1, wherein the bar graph display includes a distance indicator corresponding to a distance between the sensor and the asset.

9. The method of claim 1, wherein the bar graph display includes a signal value legend indicating units and a range of the signal values.

10. The method of claim 5, wherein the time-based display includes an indication of the threshold trigger level.

11. The method of claim 5, wherein the time-based display includes an indication of an upper hysteresis value and an indication of a lower hysteresis value.

12. A system comprising:

a rotating machinery asset;

a sensor coupled to the rotating machinery asset;

a computing device coupled to the sensor and including a display, a memory storing computer readable executable instructions, and at least one data processor configured to receive signal values from the sensor, the signal values corresponding to operation of the rotating machinery asset, wherein the at least one data processor is configured execute the instructions to perform operations including receiving data characterizing signal values;

receiving data characterizing a threshold trigger level associated with the rotating machinery asset;

determining a signal display for the rotating machinery asset; and providing the signal display in the display, wherein the signal display includes a bar graph display provided with a waveform display, and the bar graph display includes an indication of the trigger threshold level.

13. The system of claim 12, wherein the rotating machinery asset is a compressor shaft.

14. The system of claim 12, wherein the signal display is determined based on the threshold trigger level.

15. The system of claim 14, wherein the threshold trigger level is stored in the memory of the computing device.

16. The system of claim 14, wherein the threshold trigger level is provided as an input to the computing device by a user.

17. The system of claim 14, wherein the threshold trigger level is automatically determined based on the received signal values.

* * * * *